United States Patent [19]

Stemmler et al.

[11] 3,935,799

[45] Feb. 3, 1976

[54] APPARATUS FOR MAKING ENVELOPES WITH BROAD OR POINTED CLOSURES FROM A PAPER WEB

[75] Inventors: Kurt Stemmler; Günter Ehlscheid, both of Neuwied, Germany

[73] Assignee: Winkler & Dunnebier, Neuwied, Germany

[22] Filed: Feb. 28, 1974

[21] Appl. No.: 447,009

[30] Foreign Application Priority Data

Mar. 5, 1973 Germany ..... 2310944

[52] U.S. Cl. ..... 93/61 R; 93/62

[51] Int. Cl.² ..... B31B 19/02

[58] Field of Search ..... 93/63 N, 63 R, 61 R, 62, 93/8 R; 83/911

[56] References Cited

UNITED STATES PATENTS

| | | | |
|---|---|---|---|
| 1,123,617 | 1/1915 | Stone | 93/63 R |
| 2,056,336 | 10/1936 | Wolff | 93/63 R |
| 2,920,539 | 1/1960 | Doetsch | 93/63 R |

FOREIGN PATENTS OR APPLICATIONS

| | | | |
|---|---|---|---|
| 1,270,420 | 4/1972 | United Kingdom | 93/63 M |

*Primary Examiner*—James F. Coan

*Attorney, Agent, or Firm*—V. Alexander Scher

[57] ABSTRACT

Blanks removed from a paper web are cut for the making of card envelopes with a printed closure or for the making of so-called banker envelopes with a broad closure. Blanks cut for the making of card envelopes must be turned in their plane before being conveyed for the following processing. The apparatus for turning the blanks includes a turntable with suction air bores, segmented rollers, a belt acting as a slideway and conveying chains.

3 Claims, 5 Drawing Figures

Fig. 1
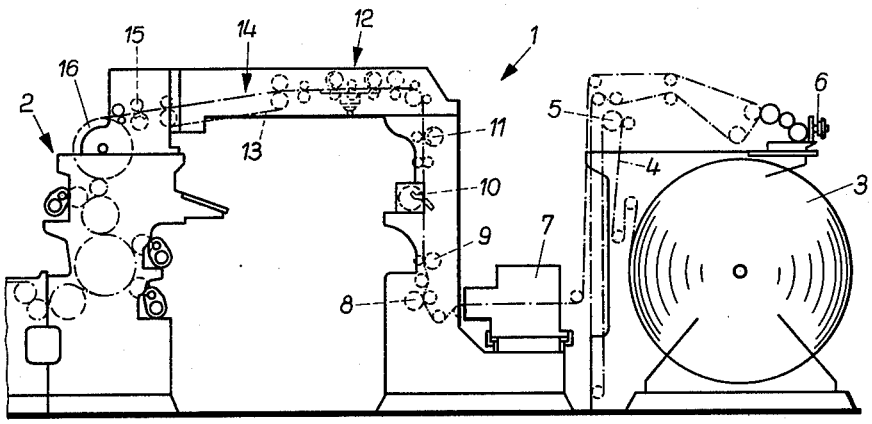
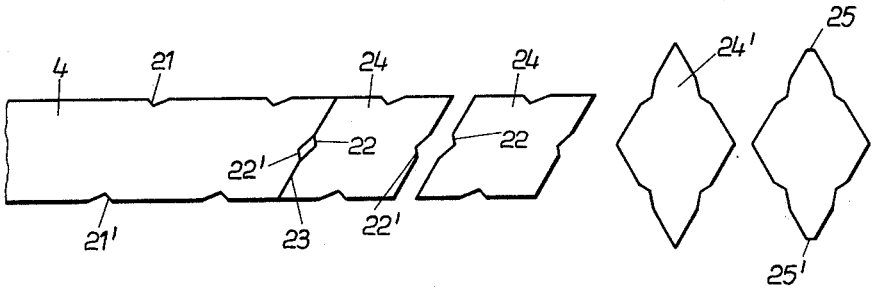
Fig. 2
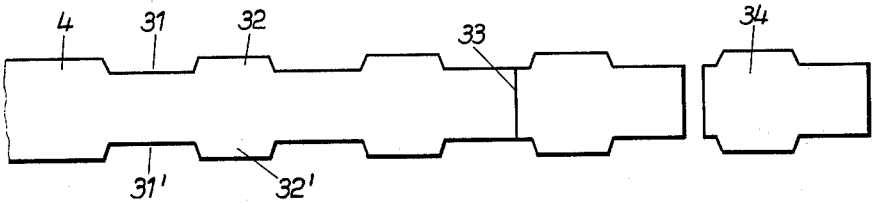
Fig. 3

APPARATUS FOR MAKING ENVELOPES WITH BROAD OR POINTED CLOSURES FROM A PAPER WEB

This invention relates to a method and an apparatus for the optional manufacture of banker or card envelopes, more particularly, the cutting to shape of the necessary envelope blanks from a paper web which is drawn off a roller and whose width is adjusted to the size and shape of the blanks. The apparatus, according to the invention, can operate as an independent unit, stacking the blanks on a depositing surface, or in a preferred embodiment as part of an envelope-manufacturing machine, it can supply the envelope blanks to the folding part of the machine.

To make it a paying proposition to produce card envelopes from the roller, blanks of parallel shape must be removed from a paper web. The shape of the envelope blank depends on the width of the paper web and the cutting angle.

In dependence on the required cutting angle, this can advantageously be done by an interchangeable knife roller which is suitable only for a predetermined cutting angle and operates on the hob method, or by a knife roller operating to produce a scissors cut, and in which the knife occupies only a slightly inclined position and cooperates with a fixed lower knife which is also at a slight inclination. The whole knife beam is pivotably disposed and occupies that inclined position in relation to the paper web which is needed for the particular cutting inclination required.

The resulting envelope blanks can be further processed on the following folding machine only if the diagonal between the tips of the bottom and closure flaps extends parallel with the conveying direction inside the folding machine. To this end, two methods are adopted in practice. In the method most frequently adopted, the whole part of the machine required for making the blanks from the paper web, starting from the paper roller and as far as the delivery of the blanks to the folding machine, such machine part being referred to hereinafter as the shape-cutting machine, it placed at an angle to the folding machine, such angle being adjustable by the pivoting of the whole shape-cutting part and being so adapted to the particular cutting inclination that, as already stated, the diagonal between the tips of the bottom and closure flaps extends parallel with the conveying direction of the folding machine.

The envelope blanks are then seized by a segmental roller disposed at the inlet to the folding machine and drawn in for further processing.

The other method, illustrated in German Pat. No. 1,038,389, consists in constructing the shape-cutting part and folding part of the machine in alignment with one another and turning the envelope blanks into the required position without changing the conveying direction after they have been parted from the web.

Machines which operate from the roller to make banker envelopes are also known. These machines are constructed in alignment and contain means disposed one after the other for processing the paper web up to the finished envelope blanks, which is delivered to the folding part of the machine without change of directional position.

German Pat. No. 1,067,673 also discloses a machine for the optional production of banker or card envelopes. In this machine, the shape-cutting part is disposed to pivot in relation to the folding part, as already described concerning machines for making card envelopes. In the making of card envelope formats, the shape-cutting part is disposed in relation to the folding part at an angle corresponding to the cutting angle; whereas, in the manufacture of banker envelopes, the cutting part is pivotally aligned with the folding machine. The cutting part contains the cutting tools required for producing card envelope blanks and also broad closure envelope blanks with shallow flap; the tools can be inserted as required.

Some of the described machines have considerable disadvantages which make it inadvisable to produce a machine for the optional production of banker or card envelopes merely by combining known features. Machines for making card envelopes and having a pivotally disposed shape-cutting part take up a lot of space. The large, heavy shape-cutting part must be moved on expensive, precisely machined guides with high supporting capacity. To exert the necessary forces and offer the required accuracy of movement, expensive motors, transmissions and gear systems must be provided. Moreover, the transfer of the blanks from the shape-cutting part to the further processing machine, which is tied up with a change in conveying direction, is always subject to inaccuracies which may cause difficulties in the further processing of the blanks.

The machine disclosed in German Pat. No. 1,038,389 does not obviate the disadvantages of a pivotable shape-cutting part, but, on the other hand, discloses a method and the means necessary for its performance for turning the blanks, which is completely unsuitable for the high production figures usual with modern machines. The reason for the inadequacy is that the blank is turned while it is being further moved wound around a cylinder. This means that the blank is not turned as required, and by a particular amount, but at the same time twisted on itself. The turning tool used is a pivotable sucker which engages with the middle of the blank and whose suction bores can only be a slight distance apart, so that they form a very small lever arm.

These low transmittable forces are opposed by the friction between the paper and the cylinder, the force required to provide the deforming work in the blank, and the mass forces occurring in the blank, at least at high speeds. The maximum permissible speeds of the machines are therefore far lower than those required at this time. There is a further limitation of the maximum speed due to the fact that the arching of the long flaps of the card envelope blanks over the cylinder gives them a considerable bending strength, so that the flaps tend to lift off the cylinder during the turning of the blank. The result of this may be that the air entering between the paper and the cylinder regularly tears the blank off the cylinder, so that disturbances in the operation of the machine are inevitable.

The machine disclosed in German Pat. No. 1,067,673 for the optional manufacture of card or banker envelopes has the same disadvantages with its pivotable shape-cutting part as a machine of this kind used exclusively for making card envelopes, which has already been described above.

It is therefore an object of the present invention to provide a method and the devices necessary for its performance for the optional manufacture of card and banker envelopes, more particularly, the necessary blanks, obviating the disadvantages of the prior art methods and apparatuses.

In accomplishing the objects of the present invention, the basic shape of the blanks can be produced in parallelogram form by cuts extending at an inclination to the direction of advance of the paper web and parallel with one another, or in rectangular shape, by cuts extending at right angles to the direction of advance of the paper web and parallel with one another, and the blanks in parallelogram shape, after being cut to shape, are so turned in their plane to produce card envelopes that the connecting line between the tips of the subsequent closure and bottom flaps comes to lie in the direction of advance of the machine, the point of intersection of such line with the connecting line between the tips of the subsequent side flaps occupying the same position in relation to the axis of symmetry of the machine before and after the turning operation, while the substantially rectangular blanks for producing banker envelopes are conveyed without any change in position or direction to the further processing part of the machine.

The invention will appear more clearly from the following detailed description when taken in connection with the accompanying drawings, showing, by way of example only, preferred embodiments of the inventive idea.

In the drawings:

FIG. 1 is a side elevation of an envelope-making machine according to the invention;

FIG. 2 shows the production of a card envelope blank from the shapes cut from a paper web;

FIG. 3 shows the production of a banker envelope blank from the shapes cut from a paper web;

Figure 4:
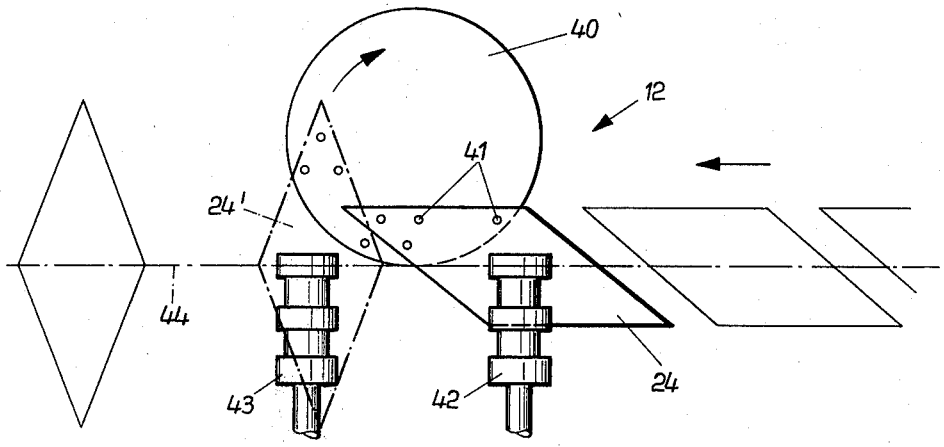
FIG. 4 illustrates diagrammatically a turning device according to the invention.

FIG. 1 illustrates an apparatus for carrying out the method according to the invention, showing a shape-cutting part 1 and a part 2 (shown sketchily) of the further processing machine. First, the operation of the shape-cutting part 1 for the making of card envelope blanks will be described:

A paper web 4 whose width is adapted to the blanks to be produced is drawn off a roller 3 and fed via deflecting rollers 5 and a printing unit 6 through a flap-cutting mechanism, which is switched off when card envelope blanks are made, to a corner-cutting station 8 where corners 21, 21′ are cut out right and left of the web, as illustrated in FIG. 2. During its further travel, the paper web 4 passes through a pair of tensioning rollers 9 and is cut up at a parting and cutting station 10 into individual blanks by parallel inclined cuts in correspondence with the required shape. At the same time, the corners 22, 22′ to be separated are also removed (FIG. 2). The cutting tool used is a shaped knife which rotates in rhythm with the machine, and into whose helical cutting edge the corner cutout is also worked. The blanks, which are still, however, interconnected by a few incompletely separated fibres, are fed to a pair of drawing-out rollers 11, rotating in rhythm with the machine, and are drawn apart from one another by the rollers 11 to a distance whose width depends on the difference between the peripheral speed of the pair of drawing-out rollers 11 and the peripheral speed of the shaped knife at the parting and cutting station 10. The blanks, which are then conveyed individually, but still with diagonals extending at an angle to the machine axis between pairs of rollers, are fed to a turning device 12, in which they are so turned that the place of intersection of their diagonals has the same position in relation to the axis of symmetry of the machine before and after the turning operation, although one of the diagonals, as a rule, the short diagonal, comes to lie in the direction of advance of the machine. The construction and operation of the turning device will be described hereinafter with reference to FIGS. 4 and 5.

At a regulating station 14 connected downstream of the turning device, minor inaccuracies in the position of the blanks can be corrected, and the tips of the side flaps can be removed at a side flap cutting station 15. A transfer roller 16 feeds the finished, shaped blanks to a further processing machine 2.

The operation of the shaping and cutting part 1 for the production of banker envelope blanks is similar to the above-described operation. In this case also, a paper web 4 is drawn off the roller 3 and fed by deflecting rollers 5 through the printing unit 6 to a first cutting device. This is a flap-cutting mechanism 7 which, as illustrated in FIG. 3, separates on the right and left from the paper web 4 by means of knives rotating about the axes of rotation lying substantially in the direction of movement of the paper, pieces of paper 31, 31′ whose size and shape is such that the flaps 32, 32′ left between the cutaway portions form the side flaps of the banker envelopes to be folded.

The side flaps can also be formed on the following cutting device, called the corner-cutting station 8, in the foregoing description of the production of card envelope blanks. For this purpose, however, the cutting tools must be interchangeable, and a knife roller must be used which is adapted to this particular format. The paper web prepared to this extent is fed by a pair of tensioning rollers 9 to the parting and cutting station 10, at which the web is separated into individual blanks by cuts extending at right angles to its advancing movement. A following pair of drawing-out rollers 11 draws the individual blanks apart to a distance determined by the selection of the roller diameter.

Guided between conveying rollers and the other rollers, the blanks pass the turning device 12, which is out of operation in this case, and then arrive at the regulating station 14, at which any displacements are evened out, pass through the side flap-cutting station 15, which is also out of operation, and are fed by the transfer roller 16 to the further processing machine 2.

This further processing machine 2 in no way differs, apart from the nature of the paper feed, from the heavy-duty envelope-making machines of conventional construction, equipped with feeds operating from the sheet. There is therefore no need for a detailed description. However, on the other hand, this also means that the shape-cutting part 1 produces normal blanks which can be processed by any envelope-making machine. Its advantageous properties can therefore be utilized not only in conjunction with an envelope-manufacturing machine, but also where it is independently used; for instance, in conjunction with a depositing surface, such as a roller punch.

To make clear what has been said with relation to FIG. 1, the progress of the change in shape from a paper web to the finished blank is illustrated in FIGS. 2 and 3.

FIG. 2 illustrates this operation in the making of card envelope blanks. First, the outer bending edges 21, 21′ are cut out from a paper web 4 whose width is adapted to the shape and size of the blanks to be produced. The two missing corner cutaway portions 22, 22′ are applied together with the subsequent parting cut 23. Then the blanks 24, almost finished in shape, are pulled out, turned into the position 24′ required for the further processing machine, and finally, in the last shaping operation, the tips 25, 25′ of the side flaps are parted.

FIG. 3 shows the shaping operations carried out on a paper web in the production of banker envelope blanks. In this case also, pieces of material 31, 31′ are cut out on the right and left-hand sides of a paper web 4 whose width is adapted to the size of the blanks to be produced. The flaps 32, 32′ left between the cutaway portions 31, 31′ subsequently form the side flaps. To finish the shaping, all that is needed is for the preshaped paper web to be parted by parting cuts 33 and then separated into individual blanks 34.

FIG. 4 illustrates diagrammatically a turning device according to the invention, which can be used to form a component of the shape-cutting machine illustrated in FIG. 1. The very small amount of mechanical complication is apparent. The main components are a turntable 40 with suction holes 41 and two identically constructed segmental rollers 42, 43. To control the suction air in the suction holes 41, use is made of a suction head (not shown), such as is conventionally used in envelope-manufacturing machines, and which controls the start and end of the suction path. The operation of this apparatus is just as simple as its mechanical construction. The envelope blanks 24 lying with their diagonals at an inclination to the longitudinal axis 44 of the machine and fed by conventional means (not shown), such as, for instance, belts or rollers to the turning device 12, are seized by the segmental roller 42 and guided with their tips, as shown in FIG. 4, over the suction holes 41 of the continuously rotating plate 40. In this position, the recesses in the segmental roller 42 release the blank 24, but at the same time, suction air is supplied to the suction holes 41, so that the blank 24 is retained in its position in relation to the turntable 40. Conveniently, the peripheral speed of the turntable 40 is somewhat higher than the speed of displacement of the blanks 24. This results in the advantage that the speed of the suction holes 41 disposed inside the plate correspond substantially to the speed of the paper, so that, at the moment the blank is taken over, the relative speed between the blank 24 and the suction holes 41 is extremely low, and in special cases, may even be zero, depending upon the distance of the suction hole from the center of the plate and its angular position. In the chain-dot position 24′, the suction holes 41 again release the blank. The segments of the segmental roller 43 take over the blank by their seizing edge, convey it in the direction of the machine, and transfer it to conventional transporting means (not shown) which feed it for its further processing. The arrangement of the suction holes 41 in the turntable 40 (FIG. 4) should be considered merely as an example, adapted to the blanks 24 illustrated.

Actually, the suction plate is formed with a plurality of suction air bores which can be closed or opened, for instance, by inserting and removing studs, so that the position of the operating suction holes can be adapted most satisfactorily to the position of each shape to be processed.

When a turning device of the type illustrated in FIG. 4 is used in a machine illustrated in FIG. 1, i.e., in a machine which processes both blanks which are rotated and blanks which are not rotated, the segmental rollers 42, 43 can be so adjusted, and, if necessary, combined with a further pair of transporting rollers disposed between them, that the segmental rollers 42, 43 can smoothly convey the blanks away over the stopped turntable 40.

Figure 5:
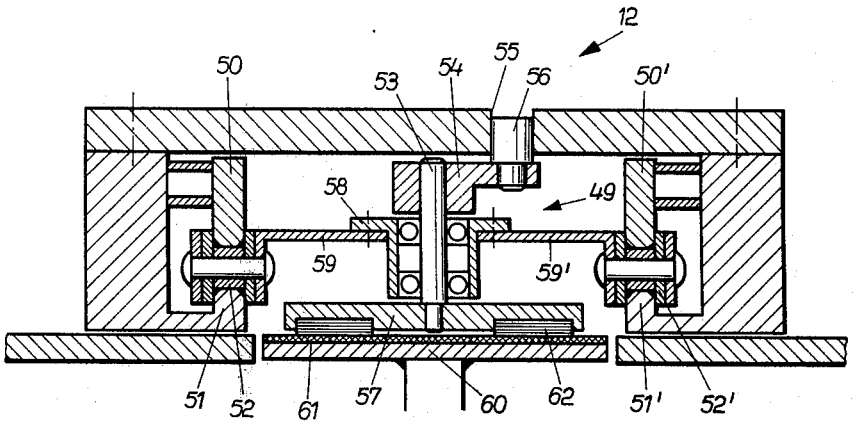
FIG. 5 is a section through a different embodiment of a turning device according to the present invention.

FIG. 5 shows a further possible embodiment of an apparatus 12 required for the method according to the invention, which turns the card envelope blanks in their plane around the point of intersection of the diagonals. Disposed between two endless conveying chains 52, 52′, one link of each of which is shown, and which run in guides 50, 50′; 51, 51′, is a conveying member 49 mainly comprising a shaft 53 which is mounted rigid axially but freely rotatable radially in anti-fraction bearings, and on one of whose ends a lever 54 with a guide pin 56 engaging in a groove 55 is disposed, a turntable 57 being disposed at its other end. The shaft 53 itself is mounted by its anti-friction bearings in a bush 58 attached by sheet metal angles 59, 59′ to the chain links 52, 52′. Disposed beneath the turntable is a table 60 on whose top an endless belt 61 coated with a substance of very low frictional coefficient runs.

In contrast, the turntable contains segmental or annular inserts 62 of a material of very high frictional coefficient.

The conveying chains and conveyor belt are deflected and returned by sprocket wheels (not shown) or belt rollers at the inlet and delivery side of the turning device. The returning run of the belt runs below the apparatus and that of the chains above it. At the place where the chains and belt run together, the card envelope blanks delivered by conventional conveying means are taken over by the apparatus between the turntable 57 and the belt 61 and conveyed onwards in the direction of the machine. The guide pin 56 slides along in the groove 55 extending at a varying inclination to the direction of the machine, depending upon the required turning angle of the blanks, and transmits a turning movement to the turntable 57. Since a suitable selection of the material of the surfaces of the turntable 57 and belt 61 makes the friction between the plate surface and the paper far greater than the friction between the belt surface and the paper, this turning movement is transmitted to the blank; i.e., it finally carries out a rectilinear movement in the direction of the machine, on which a rotary movement is superimposed. At the outlet from the turning device, the conveying chains and belt run apart again, and the blank is released and can then be taken over by conventional conveying means in a position most favorable for further processing. FIG. 5 shows only one conveying member 49. However, in the practical embodiment of a turning device 12 of the type specified, a number of such conveying members are conveniently disposed, distributed uniformly over the length of the chains. The belt 61 must also run against the turntable 57 with a contact pressure which can be determined in advance. This can be done in a very convenient manner by the table 60 being raised by compression springs (not shown).

What is claimed is:

1. In a machine for optionally manufacturing card and banker envelopes for use with a processing device, an apparatus for turning the blanks parted from a continuously fed paper web, which lie with their diagonals at an inclination to the longitudnal axis of the machine and are conveyed one after the other in the longitudinal axis of the machine, said apparatus comprising a turntable which is disposed in the conveying plane of the blanks, rotates in dependance on the machine speed and is disposed with its axis of rotation outside the axis of symmetry of the machine, means having a plurity of suction air bores adapted to engage the blanks, a segmental roller disposed upstream of the turntable to feed the blanks, and a segmental roller disposed downstream of the turntable to receive the turned blanks.

2. An apparatus for turning the blanks parted from a continuously fed paper web, which lie with their diagonals at an inclination to the longitudinal axis of the machine and are conveyed one after the other in the longitudinal axis of the machine as set forth in claim 1, comprising a slideway made of a material having a low coefficient of friction and at least one conveying member mounted to rotate freely around its central axis, and having a material of higher coefficient of friction, conveying chains which can be moved in the direction of the paper, said member being located between said chains, and means for turning said conveying member in dependence on its movement in the direction of the paper.

3. An apparatus as set forth in claim 2, comprising a slideway having the form of an endless belt which can be moved in the conveying direction of the paper.

* * * * *